US007724248B2

(12) United States Patent
Saito

(10) Patent No.: US 7,724,248 B2
(45) Date of Patent: May 25, 2010

(54) IMAGE DISPLAY APPARATUS HAVING DEFORMATION DETECTION

(75) Inventor: Akio Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 945 days.

(21) Appl. No.: 11/249,401

(22) Filed: Oct. 14, 2005

(65) Prior Publication Data

US 2006/0082565 A1 Apr. 20, 2006

(30) Foreign Application Priority Data

Oct. 19, 2004 (JP) ..... 2004-304210
Oct. 5, 2005 (JP) ..... 2005-292316

(51) Int. Cl.
*G09G 5/00* (2006.01)

(52) U.S. Cl. ..... 345/214; 345/74.1

(58) Field of Classification Search ..... 345/74.1, 345/75.1, 75.2, 204, 214, 76–78, 212; 315/169.3; 313/310, 495–497
See application file for complete search history.

(56) References Cited

U.S. PATENT DOCUMENTS 5,347,870 A * 9/1994 Dosch et al. ..... 73/769
6,118,214 A * 9/2000 Marcotte ..... 313/582
6,690,344 B1 * 2/2004 Takeuchi et al. ..... 345/85
7,126,254 B2 * 10/2006 Nanataki et al. ..... 310/324
2003/0227441 A1 * 12/2003 Hioki et al. ..... 345/156
2005/0128173 A1 * 6/2005 Booh et al. ..... 345/87

FOREIGN PATENT DOCUMENTS

JP 07-210109 8/1995
JP 8-55567 2/1996
JP 09-320496 12/1997

* cited by examiner

*Primary Examiner*—Chanh Nguyen
*Assistant Examiner*—Allison Walthall
(74) *Attorney, Agent, or Firm*—Fitzpatrick, Cella, Harper & Scinto

(57) ABSTRACT

An image display apparatus includes a display panel that displays an image, and a detecting unit that detects a magnitude of deformation of the display panel. In addition, a control unit controls display on the display panel according to an output of the detecting unit such that the magnitude of deformation of the display panel becomes equal to or smaller than a predetermined value.

9 Claims, 9 Drawing Sheets

IMAGE DISPLAY APPARATUS HAVING DEFORMATION DETECTION

BACKGROUND OF THE INVENTION

1. Field of the Invention

The present invention relates to an image display apparatus.

2. Description of the Related Art

In recent years, attention has been drawn to light-emitting flat panel display apparatuses. A light-emitting flat panel display apparatus displays an image by irradiating a fluorescent material with electron beams emitted from an electron source to generate fluorescent light. In such a display apparatus, electrons collide with the fluorescent material to emit fluorescent light, current is applied to electron emitter elements to emit electrons, and the electron emitter elements arranged on a plane are sequentially driven through electric wires, thereby generating heat. Through the heat generation, a temperature difference is caused between the face plate and the rear plate, and distortion or color deviation might be caused in the screen due to the difference in thermal expansion.

Japanese Unexamined Patent Publication No. 8-55567 discloses an image display apparatus that is equipped with an air blower for distributing air between the display panel and the exterior casing. In the image display apparatus, a material with high heat conductance is employed to facilitate heat exchange.

SUMMARY OF THE INVENTION

An object of the present invention is to provide an image display apparatus that causes smaller strain (magnitude of a deformation).

Another object of the present invention is to provide an image display apparatus that can perform image display control in accordance with strain.

To achieve the above objects, the present invention provides the following structure.

According to a first aspect of the present invention, there is provided an image display apparatus comprising:

a display panel that displays an image; and a control unit that controls display on the display panel so that strain of the display panel is restricted to a quantity equal to or smaller than a predetermined strain value, based on a physical quantity that varies according to the strain of the display panel.

With the image display apparatus of the present invention, the strain can be reduced.

Also, with the image display apparatus of the present invention, image display control in accordance with the strain can be performed.

DESCRIPTION OF THE PREFERRED EMBODIMENTS

The following is a detailed description of preferred embodiments of the present invention, with reference to the accompanying drawings. It should be noted that the sizes, materials, shapes, relative positions and the like of the components of the following embodiments are not designed to limit the scope of the present invention, unless otherwise specifically mentioned. Also, the materials, shapes and the like of the components once described are the same as those described thereafter, unless otherwise mentioned.

First Embodiment

Figure 1:
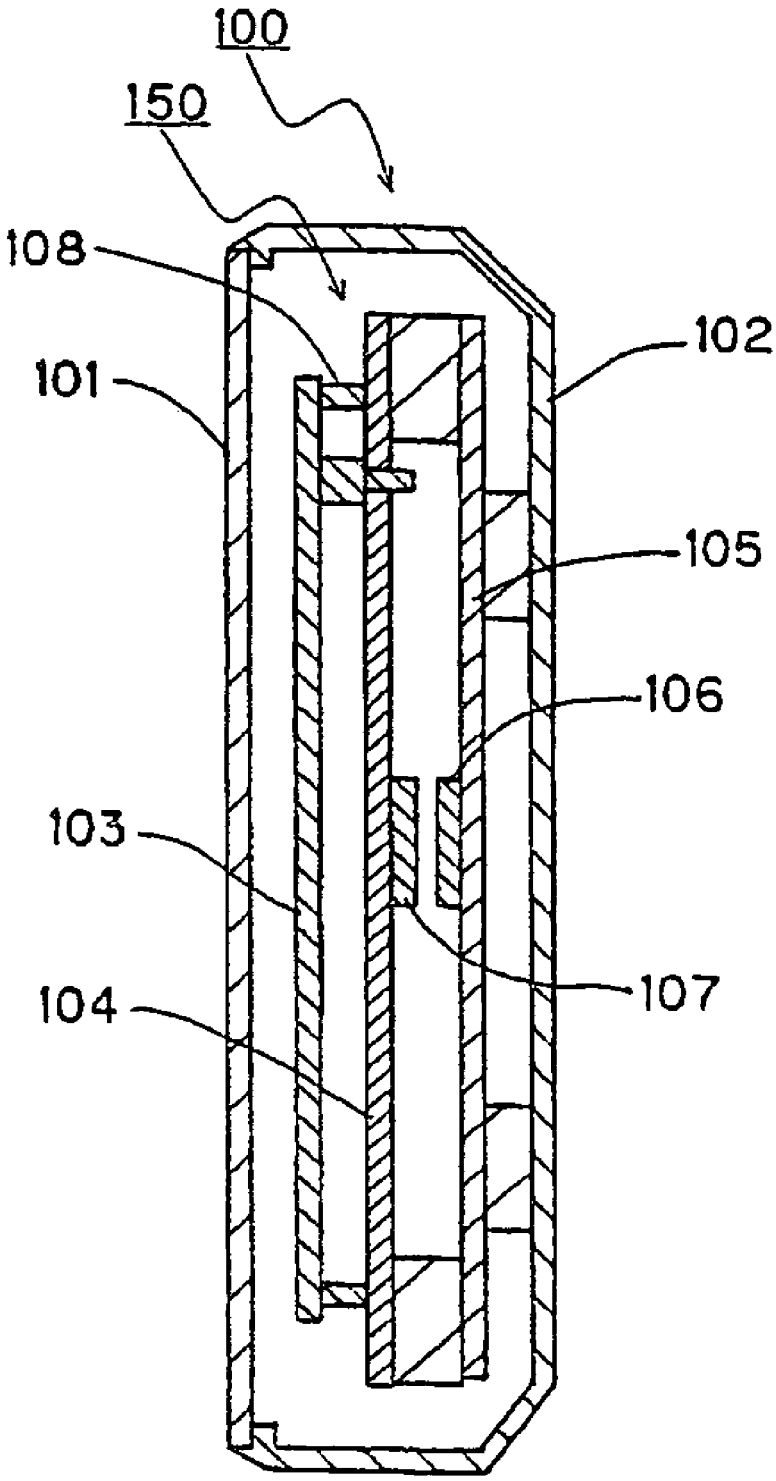
FIG. 1 is a cross-sectional view of an image display apparatus when not displaying an image in accordance with a first embodiment of the present invention.
Figure 2:
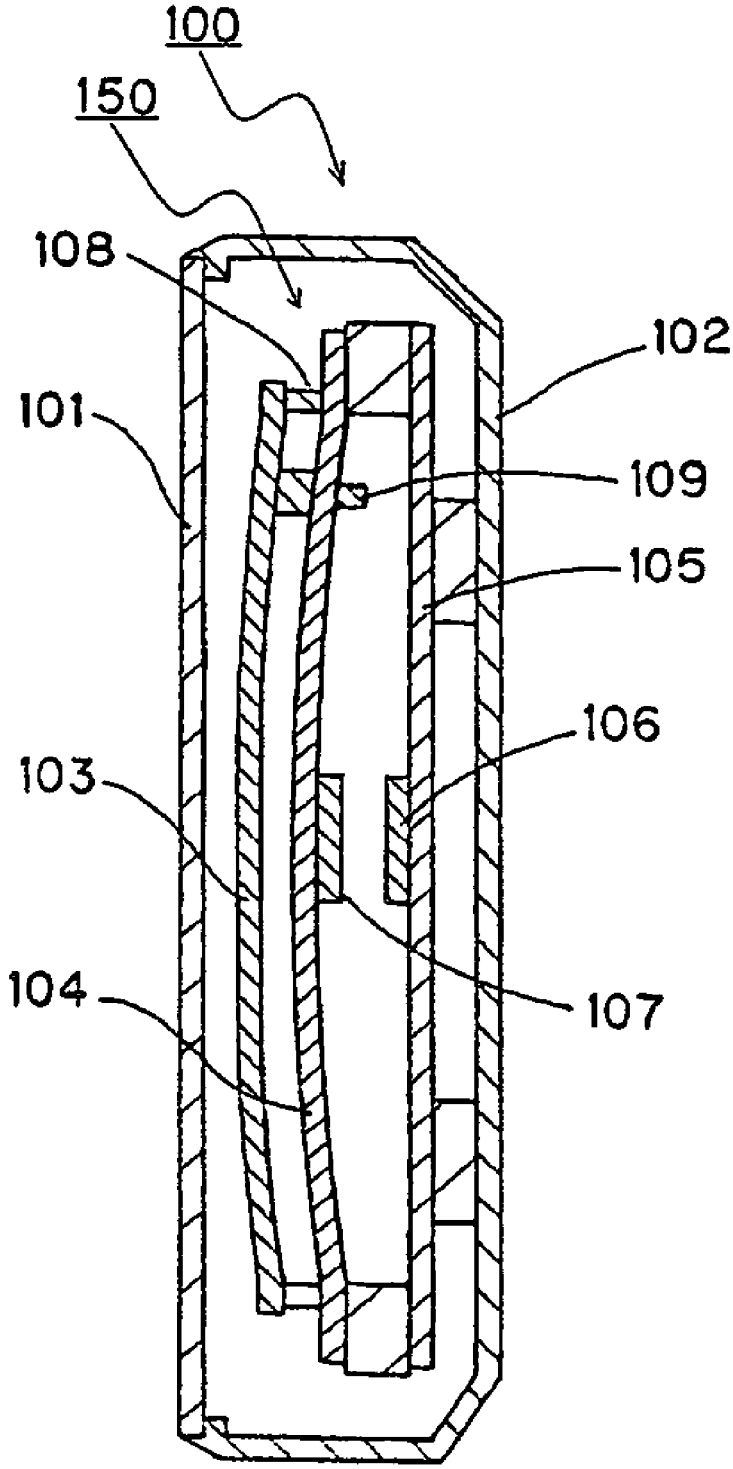
FIG. 2 is across-sectional view of the image display apparatus when displaying a high-tone image in accordance with the first embodiment of the present invention.
Figure 3:
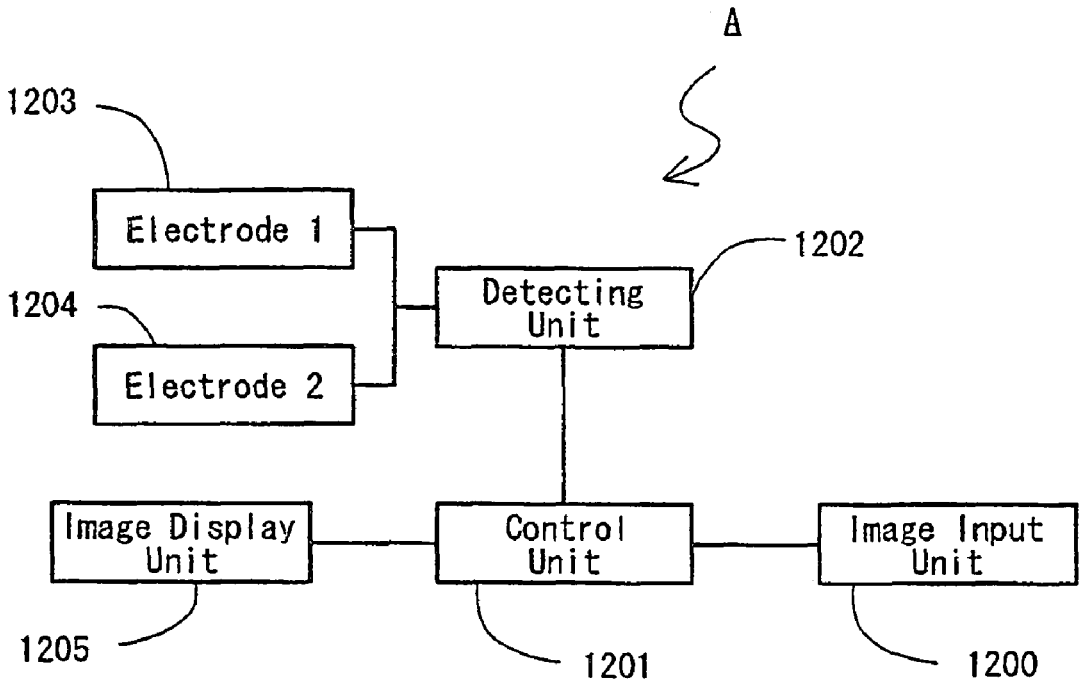
FIG. 3 is a circuit block diagram of the image display apparatus in accordance with the first embodiment of the present invention.

FIG. 1 is a cross-sectional view of an image display unit when not displaying an image in accordance with a first embodiment. In the situation illustrated in FIG. 1, the power supply is not turned on FIG. 2 is a cross-sectional view of the image display unit when displaying a high-tone (high-luminance) image in accordance with the first embodiment. In the situation illustrated in FIG. 2, the power supply is turned on, a high-tone image is input, and high power is supplied to the face plate. FIG. 3 is a circuit block diagram of the image display apparatus in accordance with the first embodiment.

The image display apparatus A in accordance with this embodiment includes an image display unit 100, a control unit 1201 (see FIG. 3) that drives a display panel 150, and a detecting unit 1202 (see FIG. 3) that detects strain of the display panel.

The image display unit 100 includes the display panel 150 that displays an image by irradiating a fluorescent material with electrons emitted from electron emitter elements, a holding member 105 that holds the display panel 150, a front protection plate 101 that protects the display panel 150 from the outside, and a housing 102.

The display panel 150 forms a vacuum container with a face plate 103, a rear plate 104, and a frame member 108.

A fluorescent material of three primary colors, a metal-back film, and the likes are formed on the glass substrate on the inner side (the vacuum side) of the face plate 103. A frame member 108 is a frame that forms the vacuum container, and is bonded to the face plate 103 and the rear plate 104 with low-melting glass. Also, the electron emitter elements manufactured by a method described later are formed on the rear plate 104.

Although the image display unit of this embodiment employs the electron emitter elements, the present invention is not limited to such a structure, and may be applied to an EL display, a plasma display, a liquid crystal display, or the like.

Figure 4:
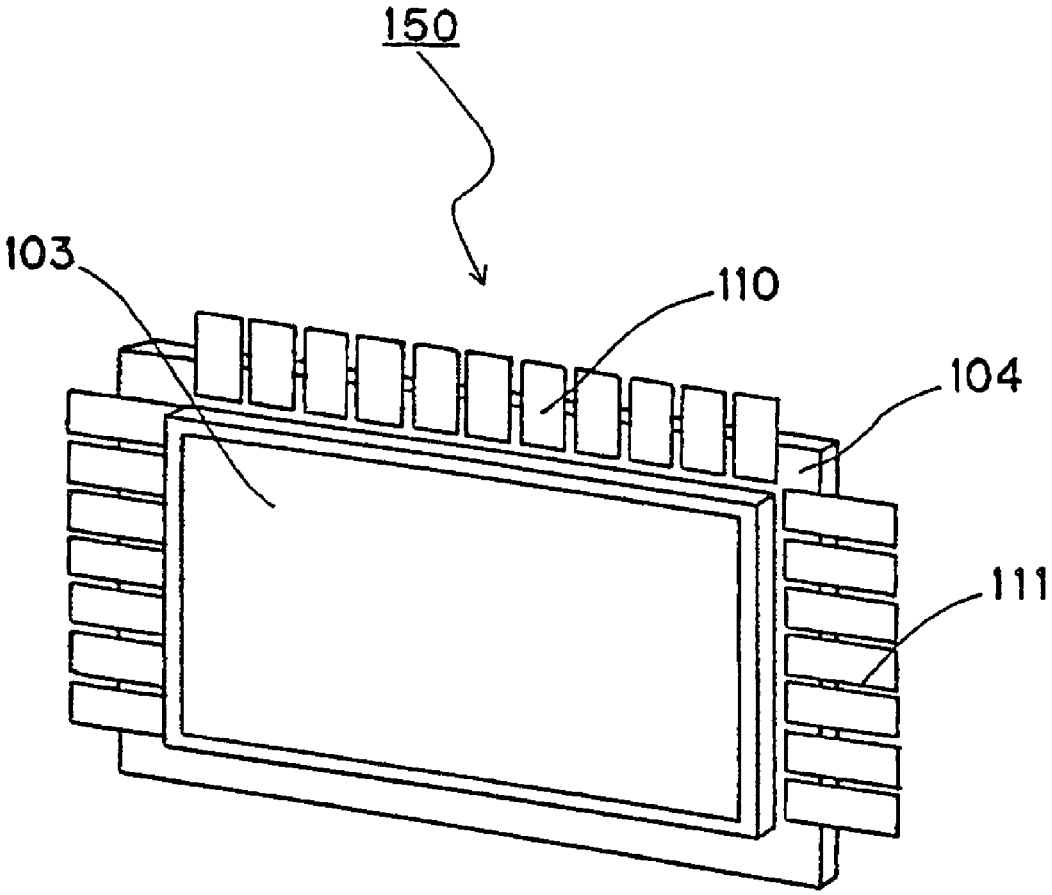
FIG. 4 is a perspective view of the display unit of the image display apparatus in accordance with the first embodiment of the present invention.

FIG. 4 is a perspective view of the display panel of the image display apparatus in accordance with the first embodiment.

The display panel 150 includes an X-flexible cable 110 for transmitting electric driving signals (pulse-width signals representing image data) for image display to the electron emitter elements, and a Y-flexible cable 111 for transmitting electric driving signals (scanning-line select signals) for image display to the electron emitter elements.

The X-flexible cable 110 has one end connected to a driving circuit with a connector, and has the other end connected to the rear plate 104 via an anisotropic conductive film. The Y-flexible cable 111 has one end connected to a scanning circuit with a connector, and has the other end connected to a circuit pattern formed on the rear plate 104 via an anisotropic conductive film.

In the image display unit 100, the holding member 105 is disposed to face the display panel 150 at a distance. The holding member 105 is made of a material with the necessary rigidity for supporting and securing the display panel 150 to the housing 102. Further, a first electrode 107 is fixed to the side (the rear plate 104) facing the holding member 105 of the display panel 150. A second electrode 106 facing the first electrode 107 is fixed to the holding member 105.

In the block diagram of FIG. 3 illustrating the image display apparatus A, the electrode 1 (1203) is equivalent to the first electrode 107, and the electrode 2 (1204) is equivalent to the second electrode 106.

Signals of videos (images) to be displayed are input to an image input unit 1200. The detecting unit 1202 detects a strain caused in the display panel 150, based on the capacitance varying with the distance between the electrode 1 (1203) and the electrode 2 (1204).

The strain of the display panel 150 relates to deformation of the display panel 150. The strain of the display panel 150 indicates the degree of the deformation of the display panel. The strain can be detected by measuring the physical quantity that is caused to change by the degree of the deformation. Examples of the physical quantities include the distance between the representative point (a measurement point) of the display panel 150 and the reference point for measuring deformation, and the capacitance varying with the distance.

The control unit 1201 performs tone control (tone correction) for luminance control and contrast control on each input image. Based on the capacitance obtained from the detecting unit 1202 or the strain calculated from the capacitance, the control unit 1201 can output the driving voltages or the driving pulse widths of input RGB signals after varying them stepwise. The image display unit 1205 includes the face plate 103, the rear plate 104, a high-voltage power source, and a driver. The image display unit 1205 outputs the waveform of the pulse width according to the luminance (tone) of the image, to each X driver. The image display unit 1205 then selects Y drivers in linear sequence, thereby forming the image.

Figure 5:
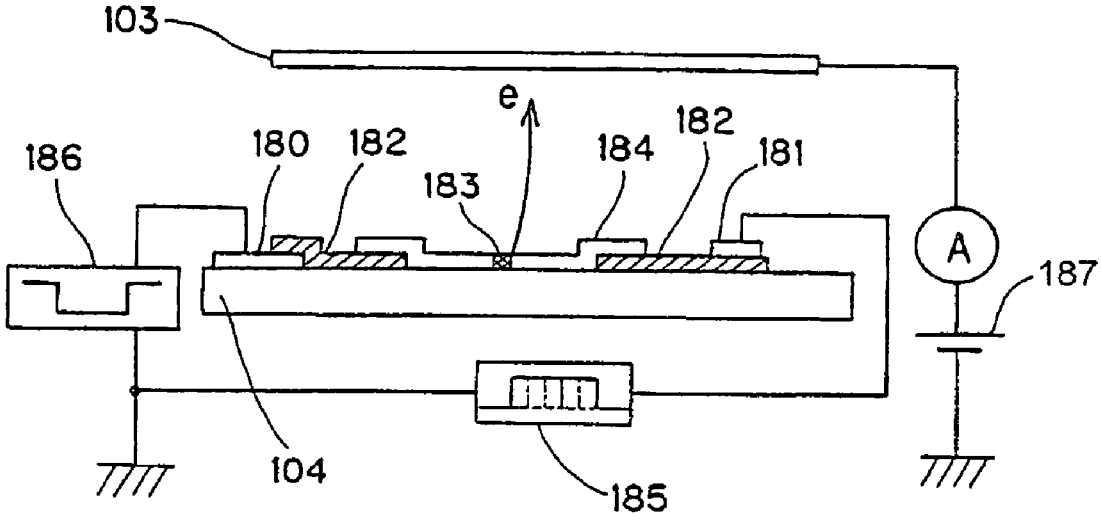
FIG. 5 is a schematic cross-sectional view of the display panel in accordance with the first embodiment of the present invention.

Referring now to FIG. 5, the production method, the fundamental structure, and the operation principles of the image display unit are described. FIG. 5 is a schematic cross-sectional view of the display panel in accordance with this embodiment.

First, a positive electrode and a negative electrode for electron emission are formed with conductive films on each pixel location on the rear plate 104 on the rear surface. The positive electrode and the negative electrode are disposed to face each other at a distance of several tens of μm. After X-direction wires 180 for guiding electric signals from an electric circuit outside the vacuum void to the positive electrode are formed by a print process, interlayer insulators for electrically insulating the X-direction wires from Y-direction wires 181 (described later) are formed at the crossing points between the Y-direction wires 181 and the X-direction wires 180. After that, the Y-direction wires 181 for guiding electric signals from the electric circuit outside the vacuum void to the negative electrode are formed by a print process. Further, a conductive film 184 formed with fine particles connecting the positive electrodes and the negative electrodes is formed, and electric potential is applied to the positive electrodes and the negative electrodes, thereby forming an electron emitter 183 as part of the conductive film 184.

Meanwhile, a black stripe film for increasing the contrast, fluorescent films of the hues of the three primary colors RGB, and a conductive metal-back film are formed in this order on the vacuum void side of the face plate 103 facing the rear plate 104.

Next, the operation of the electron emitter elements is described. A voltage of several over ten V is applied to the X-direction wire 180 and the Y-direction wire 181 selected by the electric circuit, so that electrons are emitted from the electron emitter elements. The emitted electrons are accelerated by the positive electric potential of over ten kV supplied from an external high-voltage power source to the metal-back film on the vacuum void side of the face plate 103. The electrons then collide with the fluorescent films, which then emit light.

The X-flexible cable 110 and the Y-flexible cable 111 connect the rear plate 104 to the electric circuit. The X-flexible cable 110 and the Y-flexible cable 111 are electrically and mechanically connected with a connector on the side of the electric circuit, and are electrically and mechanically connected with an anisotropic conductive film on the side of the rear plate 104 to the electrodes (the wire ends) of the X-direction wires 180 and the Y-direction wires 181 printed on the rear plate 104.

The high-voltage cable connects the metal-back film on the face plate 103 to the high-voltage power supply circuit. The high-voltage cable is electrically and mechanically connected with a connector on the side of the high-voltage power supply circuit, and are electrically and mechanically connected on the side of the face plate 103 to the metal back via a high-voltage terminal provided at a through hole formed in the rear plate 104.

Here, an example of power generated at the time of driving the image display apparatus A is the power per pixel, with the number of pixels being 1024×768×3 (RGB), the data voltage to be applied to the X-direction wires 180 being 5V, the select voltage to be applied to the Y-direction wires 181 being −15 V, and the accelerating voltage being 10 kV.

Figure 6:
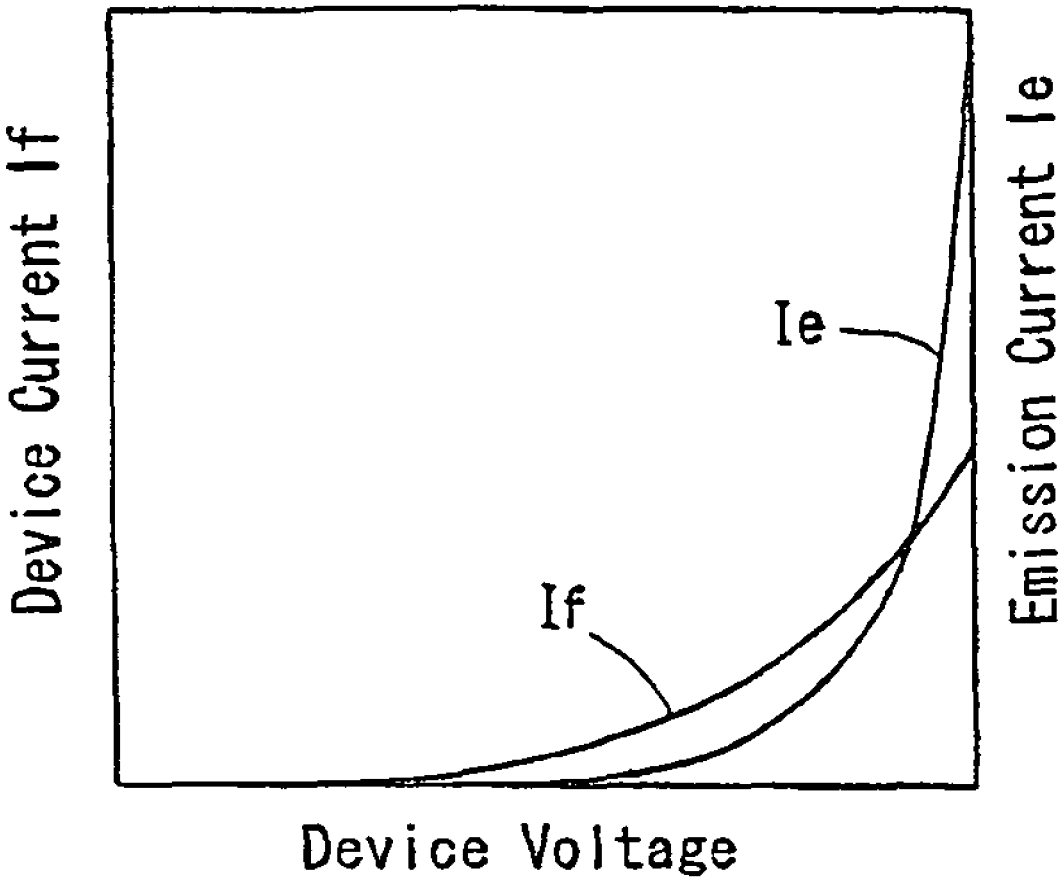
FIG. 6 is a graph showing the voltage-current curve characteristics of the electron emitter in accordance with the first embodiment of the present invention.

FIG. 6 shows the voltage-current curve characteristics of the electron source. As shown in FIG. 6, when the device voltage increases, the device current and the emission current exponentially increase.

In FIG. 5, the power to be consumed by the face plate 103 and the rear plate 104 when displaying a black image (at the time of non-light emission) can be calculated in the following manner. Pulse width modulation is performed on a data voltage 186 which is applied to the X-direction wires 180, and the consumed power is 0 W as the output is 0 V. Also, the black select current by the select voltage 185 which is applied to the Y-direction wires 181 is approximately 0.02 mA. Accordingly, the power of each electron emitter element formed on the rear plate 104 is 15 V×0.02 mA=0.3 mW.

The power generated from the face plate 103 is 10 kV×0 mA=0 W, since few electrons are emitted from the rear plate 104.

In the case of displaying a white image (at the time of light emission), the data voltage 186 to be applied to the X-direction wires 180 is 5 V, the select voltage 185 to be applied to the Y-direction wires 181 is −15 V, and the current flowing is 0.25 mA. Accordingly, the power of each electron emitter element formed on the rear plate 104 is 20 V×0.25 mA=5 mW.

The power consumed by each element is approximately 3 μA, and the accelerating voltage 187 to be applied between the face plate 103 and the rear plate 104 is 10 kV. Accordingly, the power consumed by the face plate 103 is 10 kV×3 μA=30 mW.

The power input consumed by the display panel 105 for the entire region is 0.3 mW×1024×3=921.6 mW per line, as the power per element on the rear plate 104 when displaying an all black image is 0.3 mW. The total power consumed by the rear plate 104 when displaying an all black image is 0.9216×0.8=0.74 W, with the blanking time being 20%.

Meanwhile, the total power consumed by the rear plate 104 when displaying an all white image is 5 mW per element, and is 5 mW×1024×3=15.36 W per line, accordingly.

As for the entire display panel 150, the output of voltage 186 of 5V from the X-direction wires 180 and the unselect voltage of 0V from the Y-direction wires 181 are applied to the lines other than the selected lines. In such a case, the current generated by the unselect voltage of 5V is 0.38 μA per element, and accordingly, the power per line is 5 V×0.38 μA×1024×3=5.84 mA.

As a result, the total power consumed by the rear plate 104 when displaying a white image is (15.36 W+5.84 mW)×0.8=12.3 W, with the blanking time being 20%.

The power consumed by the face plate 103 when displaying an all white image is 30 mW×1024×3=92.16 W per line, as the power required by each element is 30 mW. Accordingly, the total power consumed by the face plate 103 when displaying all white image in the entire display panel 150 is 92.16 W×0.8=73.7 W, with the blanking time being 20%.

As described so far, the power consumed by the rear plate 104 when displaying an all black image (all black driving) is 0.74 W, and the power consumed by the face plate 103 is 0 W. Accordingly, there is only a small difference between the power consumptions of the two plates, and thermal unbalance is not caused.

However, the power consumed by the rear plate 104 when displaying an all white image (all white driving) is 12.3 W, and the power consumed by the face plate 103 is 73.7 W. There is a difference of approximately 61.4 W between the power consumptions of the two plates, and thermal unbalance is caused between the face plate 103 and the rear plate 104 in the image display unit 100.

Since the face plate 103 and the rear plate 104 are vacuum-sealed with the frame member 108, the display panel 150 has convex deformation on the side of the face plate 103 having larger heat generation, as shown in FIG. 2.

More specifically, when an image signal of high-tone image of all white is input, the power consumption on the face plate 103 is higher than the power consumption on the rear plate 104. Accordingly, convex deformation toward the front protection plate 101 is caused on both the face plate 103 and the rear plate 104, as shown in FIG. 2. Here, the second electrode 106 is fixed to the panel holding member 105, and the first electrode 107 is fixed to the rear plate 104. As a result, the physical distance between the two electrodes becomes longer. Since the capacitance between the electrodes is inversely proportional to the distance between the electrodes, the capacitance decreases.

The control unit 1201 controls display based on the capacitance as a parameter (a physical quantity) varying corresponding to the distance between the first electrode 107 and the second electrode 106. More specifically, the control unit 1201 holds time-series data in accordance with the strain (the stress value), and calculates the strain (the stress value) from the detected capacitance. If the strain (the stress value) exceeds a predetermined value, the control unit 1201 reduces the pulse width of each RGB signal with time, and transmits the signal to the image display unit 1205.

Here, the detecting unit 1202 detects the strain of the display panel 150 from the variation of the capacitance as the parameter varying corresponding to the distance between the first electrode 107 and the second electrode 106.

Based on the calculated strain, the control unit 1201 varies the driving voltage or the driving pulse width for the display panel 150 stepwise, so as to control the display panel 150 to have strain equal to or smaller than the predetermined strain value. In the following, the case where the display panel is controlled based on the strain is explained. However, control may be performed based on the stress value, as the strain value and the stress value exhibit one-to-one correspondence.

Figure 7:
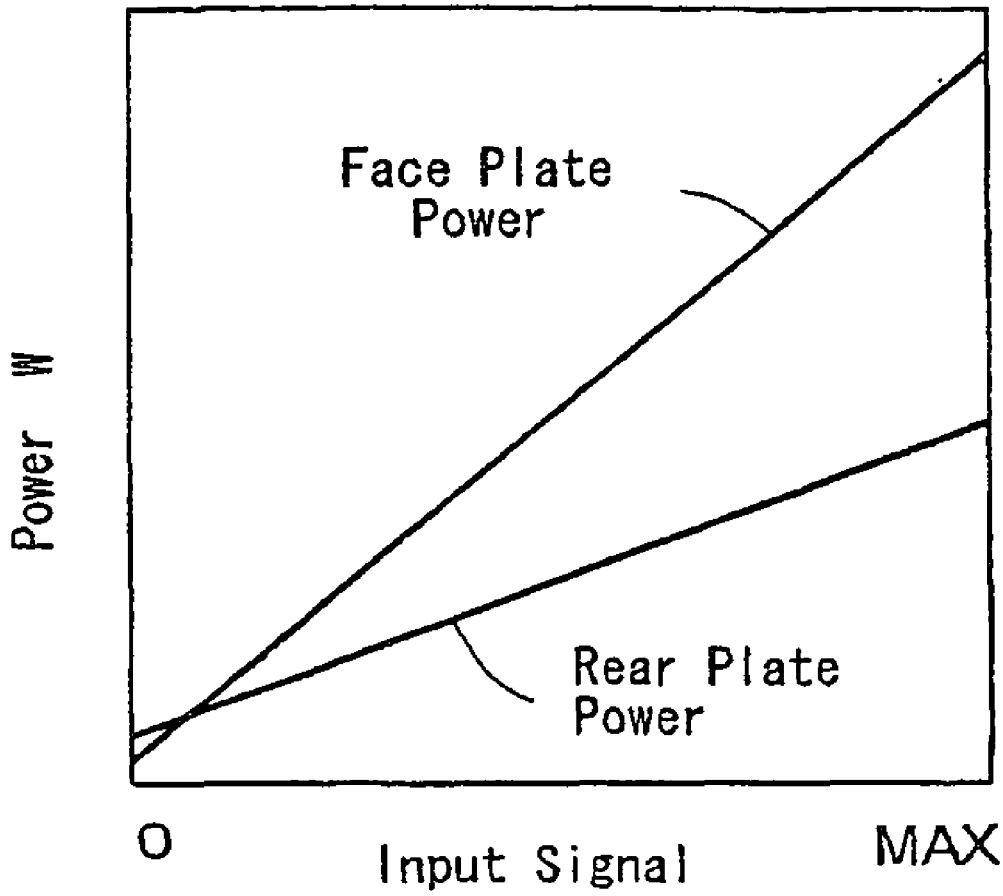
FIG. 7 is a graph showing the tone signal-to-power characteristics of the image display apparatus in accordance with the first embodiment of the present invention.

FIG. 7 is a graph showing the input signal-to-power characteristics of the image display apparatus in accordance with this embodiment. As shown in FIG. 7, the power difference between the face plate 103 and the rear plate 104 decreases as the tone (the luminance) of the input signal drops. Accordingly, the strain of the panel also decreases with time. If the strain calculated from the capacitance detected by the detecting unit 1202 is equal to or smaller than the predetermined value, the reduced RGB signals are returned to the original RGB signals.

The tone control value for reducing the power difference should preferably vary among several values in relation with the strain of the display panel 150. Based on the degree of the strain, the control unit 1201 controls the width (the driving pulse width) or the tone level (the driving voltage) for tone reduction. For example, if the calculated strain slightly exceeds the predetermined strain value, the number of tones to be reduced is made smaller so as to narrow the reduction width. If the strain becomes larger even under the control of the control unit 1201, the number of tones to be reduced is made larger, so as to widen the reduction width.

If the calculated strain decreases and the necessity of reducing the number of tones also decreases, the opposite control operation to the above is performed. More specifically, if the calculated strain is much smaller than the predetermined strain value, the number of tones to be increased should be made larger, so that the tones can be immediately returned to the original tones. If the calculated strain is only slightly below the predetermined strain value, the number of tones to be increased should be reduced, and the tones should be gradually returned to the original tones.

Through the above described control operation in accordance with this embodiment, strain and color deviation on the display can be reduced or prevented, without giving any sense of discomfort to viewers.

Although a pair of electrodes facing each other is employed in the above description, it is possible to employ more than one pair of electrodes to detect strain for control operations. With such a structure, strain and color deviation can be reduced and prevented with higher precision. Also, it is possible to perform a control operation by detecting the strain of the entire display region.

In this embodiment, the tone control is performed to reduce the temperature difference (the power difference) between components. However, it is also possible to control the driving voltage or the accelerating voltage so as to reduce the power difference.

Second Embodiment

Figure 8:
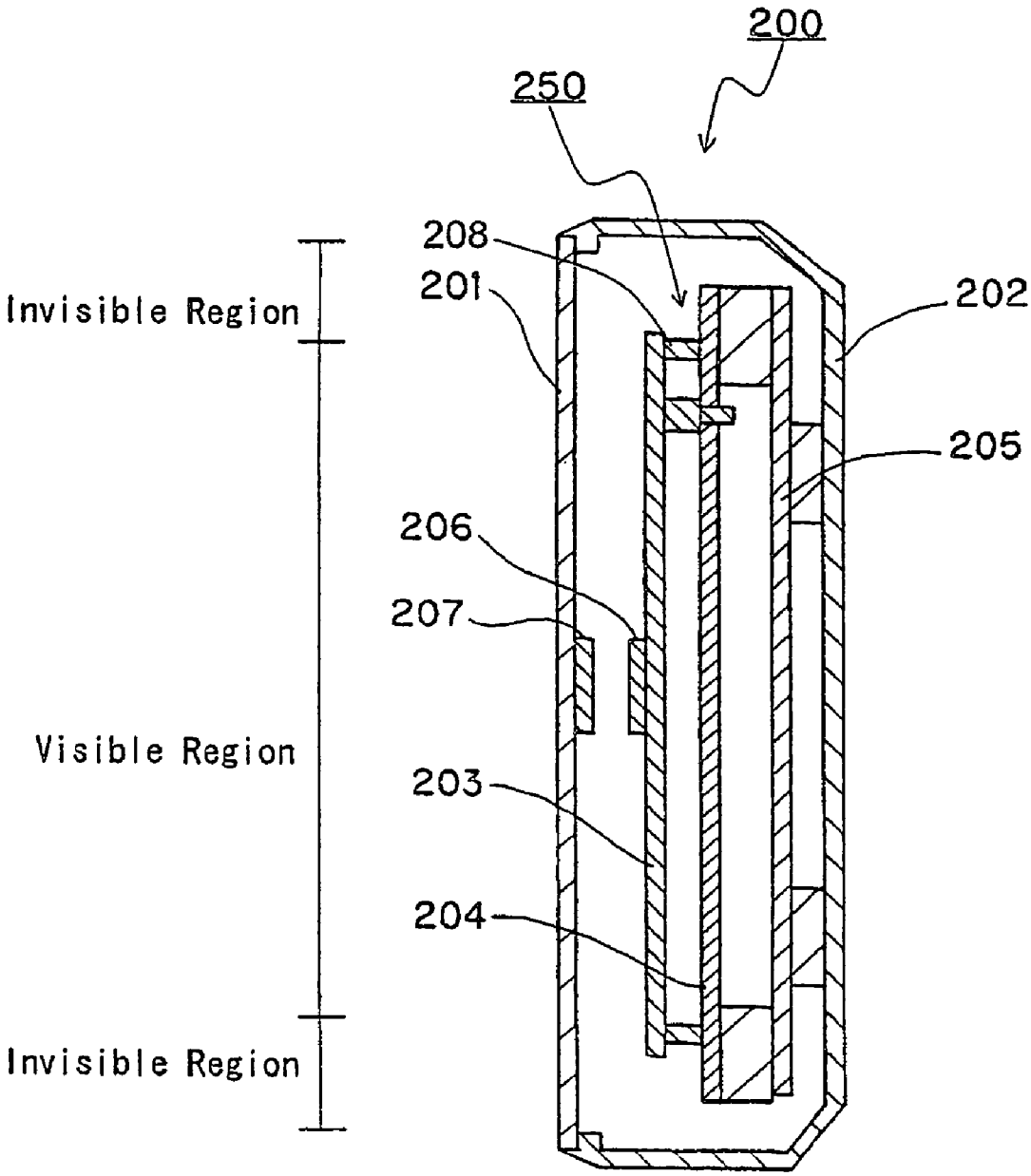
FIG. 8 is a cross-sectional view of an image display apparatus in accordance with a second embodiment of the present invention.

FIG. 8 is a cross-sectional view of an image display unit in accordance with a second embodiment of the present invention.

An image display unit 200 in accordance with the second embodiment includes a display panel 250 that displays an image by irradiating a fluorescent material with electrons emitted from an electron emitter element, a front protection plate 201 that protects the display panel 250 from the outside, and a housing 202. The front protection plate 201 is disposed to face the display side of the display panel 250 at a distance.

The display panel 250 forms a vacuum container with a face plate 203, a rear plate 204, and a frame member 208. The display panel 250 includes a first transparent electrode 206 that is disposed in a visible region on the side facing the front protection plate 201, and a second transparent electrode 207 that is disposed on the front protection plate 201 facing the first transparent electrode 206. Here, the "visible region" is the region in which an image is actually displayed when a viewer views the display panel 250 from the front side of the image display apparatus.

In this embodiment, the power difference between the face plate 203 and the rear plate 204 with a low-tone (low-luminance) image is not large, as in the first embodiment. However, with a high-tone (high-luminance) image, the power difference is large, and convex deformation is caused over the entire display panel 250 toward the front protection plate 201. As a result, large strain is caused in the display panel 250.

As the front protection panel 201 is supported by the housing 202, the distance between the first transparent electrode 206 and the second transparent electrode 207 becomes shorter, resulting in an increase in capacitance.

The control unit 1201 holds time-series data in accordance with the strain calculated based on capacitance, and calculates the strain from the detected capacitance. If the strain exceeds a predetermined value, the control unit 1201 reduces the pulse width of each RGB signal with time, and transmits a signal to the image display unit 1205.

Here, the detecting unit 1202 detects the strain of the display panel 250 from the variation of the capacitance as the parameter corresponding to the distance between the first transparent electrode 206 and the second transparent electrode 207.

Based on the calculated strain, the control unit 1201 varies the driving voltage or the driving pulse width for the display panel 250 stepwise, so as to control the display panel 250 to have strain equal to or smaller than the predetermined strain value.

For example, if the strain obtained from the detecting unit 1202 is equal to or smaller than the predetermined value, the control unit 1201 returns the reduced RGB signals to the original RGB signals.

Through the above described control operation in accordance with this embodiment, strain and color deviation on the display can be reduced or prevented, without giving any sense of discomfort to viewers. Also, the provision of the transparent electrodes in the visible region of the display panel 250 can reduce the image display unit in size, compared with the case where electrodes are disposed in an invisible region of the display panel.

Although a pair of electrodes facing each other is employed in the above description, it is possible to employ more than one pair of electrodes to detect strain for control operations. With such a structure, strain and color deviation can be reduced and prevented with higher precision. Also, it is possible to perform a control operation by detecting the strain of the entire display region.

In this embodiment, the transparent electrodes are placed in the visible region. However, in the case of using opaque electrodes, it is possible to dispose electrodes facing each other in an invisible region near the display unit, with the center portion of the display panel being supported.

For example, a first electrode may be disposed in the invisible region on the side facing the protection plate 201 of the display panel 250, while a second electrode is disposed on the protection plate facing the first electrode. The detecting unit detects the strain of the display panel from the parameter that varies according to the distance between the first electrode and the second electrode.

Third Embodiment

Figure 9:
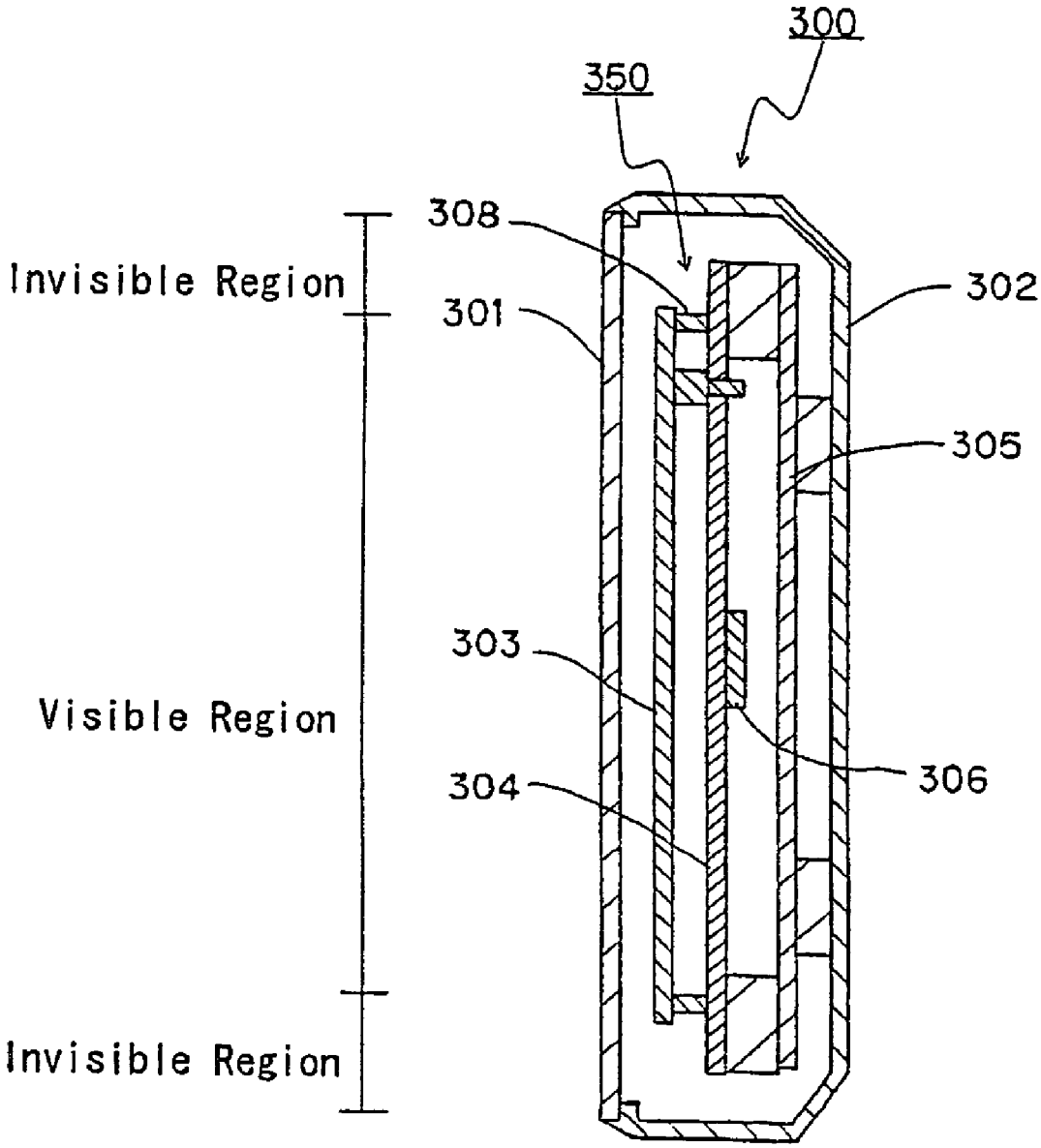
FIG. 9 is a cross-sectional view of an image display apparatus in accordance with a third embodiment of the present invention.

FIG. 9 is a cross-sectional view of an image display unit in accordance with a third embodiment of the present invention.

An image display unit 300 in accordance with the third embodiment includes a display panel 350 that displays an image by irradiating a fluorescent material with electrons emitted from an electron emitter element, a front protection plate 301 that protects the display panel 350 from the outside, and a housing 302.

The display panel 350 forms a vacuum container with a face plate 303, a rear plate 304, and a frame member 308. In this embodiment, a strain gauge sensor 306 is attached on the back side of the rear plate 304 of the display panel 350.

In this embodiment, the power difference between the face plate 303 and the rear plate 304 is not large with a low-tone (low-luminance) image, as in the first and second embodiments. However, with a high-tone (high-luminance) image, the power difference becomes large, and convex deformation toward the front protection plate 301 is caused in the entire display panel 350. Thus, the display panel 350 is distorted.

A control unit 1201 holds time-series data in accordance with the strain detected by the strain gauge sensor 306. Based on the strain obtained from the strain gauge sensor 306, the control unit 1201 varies the driving voltage or the driving pulse width for the display panel 350 stepwise, and controls the display panel 350 so as to have equal to or smaller strain than a predetermined strain value.

More specifically, if the detected strain exceeds the predetermined strain value, the control unit 1201 reduces the pulse width of each RGB signal with time, and transmits the signal to the image display unit 1205. If the strain obtained from the strain gauge sensor 306 is equal to or smaller than the predetermined value, the control unit 1201 returns the reduced pulse widths of the RGB signals to the original pulse widths of the RGB signals.

Through the above described control operation in accordance with this embodiment, strain and color deviation on the display can be reduced or prevented, without giving any sense of discomfort to viewers.

Although only one strain detector is employed in the above described structure, more than one strain detectors may be employed to detect strain for control operations. With such a structure, strain and color deviation can be reduced or prevented with higher precision. Also, a strain gauge sensor may be attached to the invisible region on the display side of the display panel 350, so as to detect strain.

In each of the above described embodiments, the detecting circuit for detecting capacitance or a strain gauge sensor is employed as a circuit for detecting strain. Other than those structures, it is possible to employ a structure with a mechanical contact that switches on or off when the distance between a reference location and a predetermined location on the display panel becomes longer than a predetermined distance. In such a structure, the circuit including the mechanical contact serves as the detecting circuit that detects the distance between contacts as a physical quantity varying according to the strain. Display control is performed to control the power consumption through the contact state (ON or OFF state), so as to prevent deformation of the display panel. In the present invention, the physical quantities used for display control (such as the distance between the reference location and the predetermined location on the display panel, the capacitance, and the value measured by the strain gauge sensor) vary according to the strain. Here, the physical quantities that vary according to the strain are not limited to those quantities varying precisely according to the strain. For example, a physical quantity that discontinuously varies according to skewness that gradually varies may be employed.

However, the physical quantity of temperature is not included in the above physical quantities varying according to strain, because the strain is caused by a temperature difference and the temperature difference is not caused by the strain.

In the present invention, display is controlled in accordance with the physical quantity varying according to the strain, instead of the measured cause (the temperature) of strain. Thus, strain can be restricted with higher precision.

This application claims priority from Japanese Patent Application No. 2004-304210 filed on Oct. 19, 2004 and Japanese Patent Application No. 2005-292316 filed on Oct. 5, 2005, which are hereby incorporated by reference herein.

What is claimed is:

1. An image display apparatus comprising:

a display panel that displays an image;

a detecting unit that detects a magnitude of deformation of the display panel;

a control unit that controls display on the display panel according to an output of the detecting unit such that the magnitude of deformation of the display panel becomes equal to or smaller than a predetermined value; and a holding member, separate from the display panel, that holds the display panel, and is disposed to face the display panel, wherein the detecting unit comprises:

a first electrode disposed on a side of the display panel that is facing the holding member; and a second electrode disposed on the holding member and facing the first electrode, wherein the detecting unit detects the magnitude of deformation of the display panel by measuring a physical quantity corresponding to a distance between the first electrode and the second electrode, and wherein the physical quantity is capacitance between the first electrode and the second electrode, the magnitude of deformation of the display panel is calculated from a variation of the capacitance; and the control unit changes a driving voltage or a driving pulse width for the display panel for controlling the display on the display panel.

2. An image display apparatus according to claim 1, wherein said display panel comprises a rear plate having an electron-emitter, a face plate having a metal back and a fluorescent film to be irradiated with electrons emitted from the electron-emitting device, and a frame member disposed between the face plate and the rear plate, with said driving voltage or said driving pulse being applied to said metal back or said electron emitter, and wherein the holding member is disposed opposite to the rear plate.

3. An image display apparatus according to claim 2, wherein the first electrode is disposed on a side of the rear plate that faces the holding member.

4. An image display apparatus comprising:

a display panel that displays an image;

a detecting unit that detects a magnitude of deformation of the display panel;

a control unit that controls display on the display panel according to an output of the detecting unit such that the magnitude of deformation of the display panel becomes equal to or smaller than a predetermined value; and a protection plate, separate from the display panel, that protects the display panel, and is disposed to face the display side of the display panel;

wherein the detecting unit comprises:

a first electrode disposed in an invisible region on a side of the display panel that is facing the protection plate; and a second electrode disposed on the protection plate and facing the first electrode, wherein the detecting unit detects the magnitude of deformation of the display panel by measuring a physical quantity corresponding to a distance between the first electrode and the second electrode, and wherein the physical quantity is capacitance between the first electrode and the second electrode;

the magnitude of deformation of the display panel is calculated from a variation of the capacitance; and the control unit changes a driving voltage or a driving pulse width for the display panel for controlling the display on the display panel.

5. An image display apparatus according to claim 4, wherein said display panel comprises a rear plate having an electron-emitter, a face plate having a metal back and a fluorescent film to be irradiated with electrons emitted from the electron-emitting device, and a frame member disposed between the face plate and the rear plate, with said driving voltage or said driving pulse being applied to said metal back or said electron emitter, and wherein the protection plate is disposed opposite to the rear plate.

6. An image display apparatus according to claim 5, wherein the first electrode is disposed on a side of the rear plate that faces the protection plate.

7. An image display apparatus comprising:

a display panel that displays an image;

a detecting unit that detects a magnitude of deformation of the display panel;

a control unit that controls display on the display panel according to an output of the detecting unit such that the magnitude of deformation of the display panel becomes equal to or smaller than a predetermined value; and a protection plate, separate from the display panel, that protects the display panel, and is disposed to face the display side of the display panel, wherein the detecting unit comprises:

a first transparent electrode disposed in a visible region on a side of the display panel that is facing the protection plate; and a second transparent electrode disposed on the protection plate and facing the first transparent electrode, wherein the detecting unit detects the magnitude of a deformation of the display panel by measuring a physical quantity corresponding to a distance between the first transparent electrode and the second transparent electrode, and wherein the physical quantity is capacitance between the first transparent electrode and the second transparent electrode;

the magnitude of deformation of the display panel is calculated from a variation of the capacitance; and the control unit changes a driving voltage or a driving pulse width for the display panel for controlling the display on the display panel.

8. An image display apparatus according to claim 7, wherein said display panel comprises a rear plate having an electron-emitter, a face plate having a metal back and a fluorescent film to be irradiated with electrons emitted from the electron-emitting device, and a frame member disposed between the face plate and the rear plate, with said driving voltage or said driving pulse being applied to said metal back or said electron emitter, and wherein the protection plate is disposed opposite to the rear plate.

9. An image display apparatus according to claim 8, wherein the first electrode is disposed on a side of the rear plate that faces the protection plate.

* * * * *